US009947306B2

(12) United States Patent
Ohta

(10) Patent No.: US 9,947,306 B2
(45) Date of Patent: Apr. 17, 2018

(54) ELECTRIC ACOUSTIC APPARATUS

(71) Applicant: Yamaha Corporation, Hamamatsu-shi, Shizuoka-ken (JP)

(72) Inventor: Shinichi Ohta, Hamamatsu (JP)

(73) Assignee: Yamaha Corporation, Hamamatsu-shi (JP)

( * ) Notice: Subject to any disclaimer, the term of this patent is extended or adjusted under 35 U.S.C. 154(b) by 0 days.

(21) Appl. No.: 15/408,292

(22) Filed: Jan. 17, 2017

(65) Prior Publication Data

US 2017/0206876 A1 Jul. 20, 2017

(30) Foreign Application Priority Data

Jan. 18, 2016 (JP) ..... 2016-006884

(51) Int. Cl.
*G10H 1/34* (2006.01)
*G10H 1/055* (2006.01)

(52) U.S. Cl.
CPC ..... *G10H 1/055* (2013.01); *G10H 1/34* (2013.01); *G10H 2220/271* (2013.01)

(58) Field of Classification Search
CPC ..... G10H 1/055; G10H 1/34; G10H 2220/271
USPC ..... 84/626
See application file for complete search history.

(56) References Cited

U.S. PATENT DOCUMENTS 5,319,151 A * 6/1994 Shiba ..... G10H 1/04 84/603
5,471,008 A * 11/1995 Fujita ..... G10H 1/0066 84/477 R
6,087,578 A * 7/2000 Kay ..... G10H 1/0066 84/626
6,103,964 A * 8/2000 Kay ..... G10H 1/02 84/611
6,121,532 A * 9/2000 Kay ..... G10H 1/00 84/445
6,230,140 B1 * 5/2001 Severson ..... A63H 5/00 704/278
2006/0112815 A1 * 6/2006 Sant ..... G10F 1/02 84/645
2012/0031256 A1 * 2/2012 Tsuchiya ..... G10H 1/053 84/604
2017/0206876 A1 * 7/2017 Ohta ..... G10H 1/055
2017/0221464 A1 * 8/2017 Ohta ..... G10G 5/005

FOREIGN PATENT DOCUMENTS

JP 2002-023751 A 1/2002

* cited by examiner

*Primary Examiner* — David Warren
(74) *Attorney, Agent, or Firm* — Morrison & Foerster LLP

(57) ABSTRACT

An electric acoustic apparatus includes a supply unit that supplies sound-generation information including timing information representing a start of a sound-generation, a storage storing sound control pattern data representing a pattern of over-time change of a parameter defining a behavior of a sound, a reproducer that reproduces the sound control pattern data, and a sound signal generator that generates a sound signal representing a sound according to the sound-generation information and changes the behavior of the sound based on the reproduced sound control pattern data. The reproducer controls a reproduction behavior of the sound control pattern data according to the sound-generation information.

14 Claims, 6 Drawing Sheets

| | |
|---|---|
| $SP_{x=1}$ | 1≦ KEYVELOCITY <32 |
| $SP_{x=2}$ | 32≦ KEYVELOCITY <64 |
| $SP_{x=3}$ | 64≦ KEYVELOCITY <96 |
| $SP_{x=4}$ | 96≦ KEYVELOCITY <127 |

| | |
|---|---|
| $SP_{x=1}$ | 1≦ KEY VELOCITY <32 |
| $SP_{x=2}$ | 32≦ KEY VELOCITY <64 |
| $SP_{x=3}$ | 64≦ KEY VELOCITY <96 |
| $SP_{x=4}$ | 96≦ KEY VELOCITY <127 |

ELECTRIC ACOUSTIC APPARATUS

CROSS REFERENCE TO RELATED APPLICATION(S)

This application is based upon and claims the benefit of priority of Japanese Patent Application No. 2016-6884 filed on Jan. 18, 2016, the contents of which are incorporated herein by reference in its entirety.

BACKGROUND OF THE INVENTION

1. Field of the Invention

The present invention relates to an electric acoustic apparatus for changing a behavior of a sound based on sound control pattern data representing a pattern of over-time change of a parameter defining the behavior of the sound.

2. Description of the Related Art

As described in JP-A-2002-23751 as Patent Literature 1, an electronic musical instrument is known as an electric acoustic apparatus having a musical sound control function of changing a behavior of a musical sound based on musical sound control pattern data representing a pattern of overtime change of a parameter defining the behavior of the musical sound.

Patent Literature 1: JP-A-2002-23751

SUMMARY OF THE INVENTION

The known electronic musical instrument described above includes a switch for controlling reproduction and stop of the musical sound control pattern data. A user sets the switch in a reproduction state when the musical sound control pattern data is reproduced, and the user sets the switch in a stop state when the reproduction of the musical sound control pattern data is stopped. Thus, the known electronic musical instrument only enables to switch the reproduction and the stop of the musical sound, control pattern data according to the state of the switch, and is poor in the playing representation.

A non-limited object of the present invention is to provide an electric acoustic apparatus capable of achieving better representation. In the following description of each constituent feature of the present invention, in order to facilitate understanding of the present invention, numerals of corresponding parts of an embodiment are described within parentheses, but each constituent feature of the present invention should not be limited to or construed as the constitution of the corresponding parts shown by the numerals of the embodiment.

In order to achieve the non-limited object described above, in one embodiment of the present invention, an electric acoustic apparatus includes a supply unit (KY, 15) that supplies sound-generation information including timing information representing a start of a sound-generation, a storage (12*b*, 14) storing sound control pattern data ($SP_x$) representing a pattern of over-time change of a parameter defining a behavior of a sound, a reproducer (PL) that reproduces the sound control pattern data, and a sound signal generator (16, 17) that generates a sound signal representing a sound according to the sound-generation information and changes the behavior of the sound based on the reproduced sound control pattern data. The reproducer controls a reproduction behavior of the sound control pattern data according to the sound-generation information. The sound-generation information includes, for example, a velocity or a pressure at which a user manipulates a manipulator. Also, the sound-generation information refers to, for example, a pitch, an arrangement position, or the combination of the foregoing information assigned to the manipulators in the case where the electric acoustic apparatus according to the present invention includes a plurality of manipulators.

The reproducer may modify and reproduce the sound control pattern data according to the sound-generation information.

A plurality of sound control pattern data may be stored in the storage, and the reproducer may select and reproduce sound control pattern data, from the plurality of sound control pattern data, according to the sound-generation information.

In the electric acoustic apparatus according to one embodiment of the present invention configured as described above, a playing behavior of the user or a behavior of the sound-generation information supplied from an external device is reflected in a control pattern of the behavior of the sound. For example, in the case where the electric acoustic apparatus includes a plurality of manipulators and a plurality of sound control pattern data, the sound control pattern data according to the manipulation mode of the manipulator is selected. Also, for example, the sound control pattern data is modified and reproduced according to an attribute (the pitch, the arrangement position, the combination, etc.) of the manipulator manipulated by the user or the manipulation mode of the manipulator. Consequently, the electric acoustic apparatus according to the present invention can achieve representation better than that of the known electronic musical instrument.

BRIEF DESCRIPTION OF THE DRAWINGS

In the accompanying drawings:

FIG. 6 is a functional block diagram of the electronic musical instrument in a state in which a musical sound control function is on.

DETAILED DESCRIPTION OF THE EXEMPLARY EMBODIMENTS

First Embodiment

An electronic musical instrument 10 as an electric acoustic apparatus according to a first embodiment of the present invention will be described. First, an outline of the electronic musical instrument 10 will be described. The electronic musical instrument 10 includes a musical sound control function of changing a behavior of a musical sound based on musical sound control pattern data. Like a known electronic musical instrument, the electronic musical instrument 10 includes a first operation mode of controlling reproduction and stop of the musical sound control pattern data with a start/stop switch manipulated as a trigger, and a second operation mode of controlling reproduction and stop of the musical sound control pattern data using sound-generation information supplied based on a key press manipulation or sound-generation information supplied from an external device as a trigger.

Figure 1:
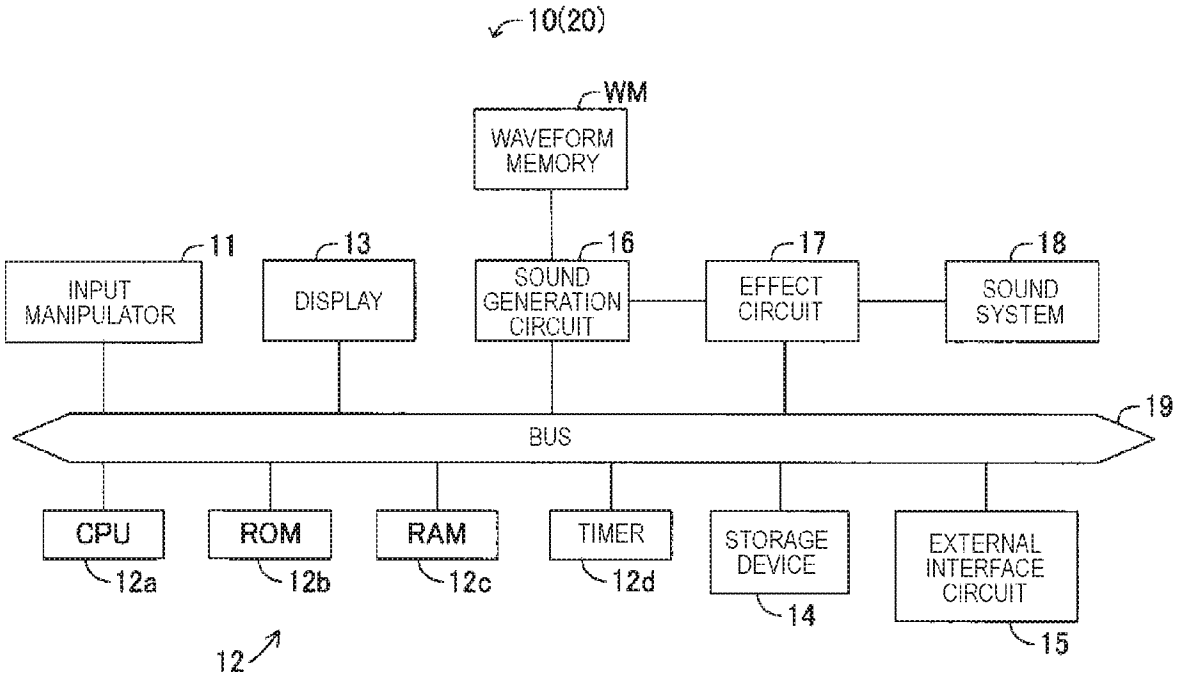
FIG. 1 is a block diagram showing an outline of an electronic musical instrument according to one embodiment of the present invention.

Next, a concrete configuration of the electronic musical instrument 10 will be described. As shown in FIG. 1, the electronic musical instrument 10 includes an input manipulator 11, a computer part 12, a display 13, a storage device 14, an external interface circuit 15, a sound generation circuit 16, an effect circuit 17 and a sound system 18. Those components are connected through a bus 19.

Figure 2:
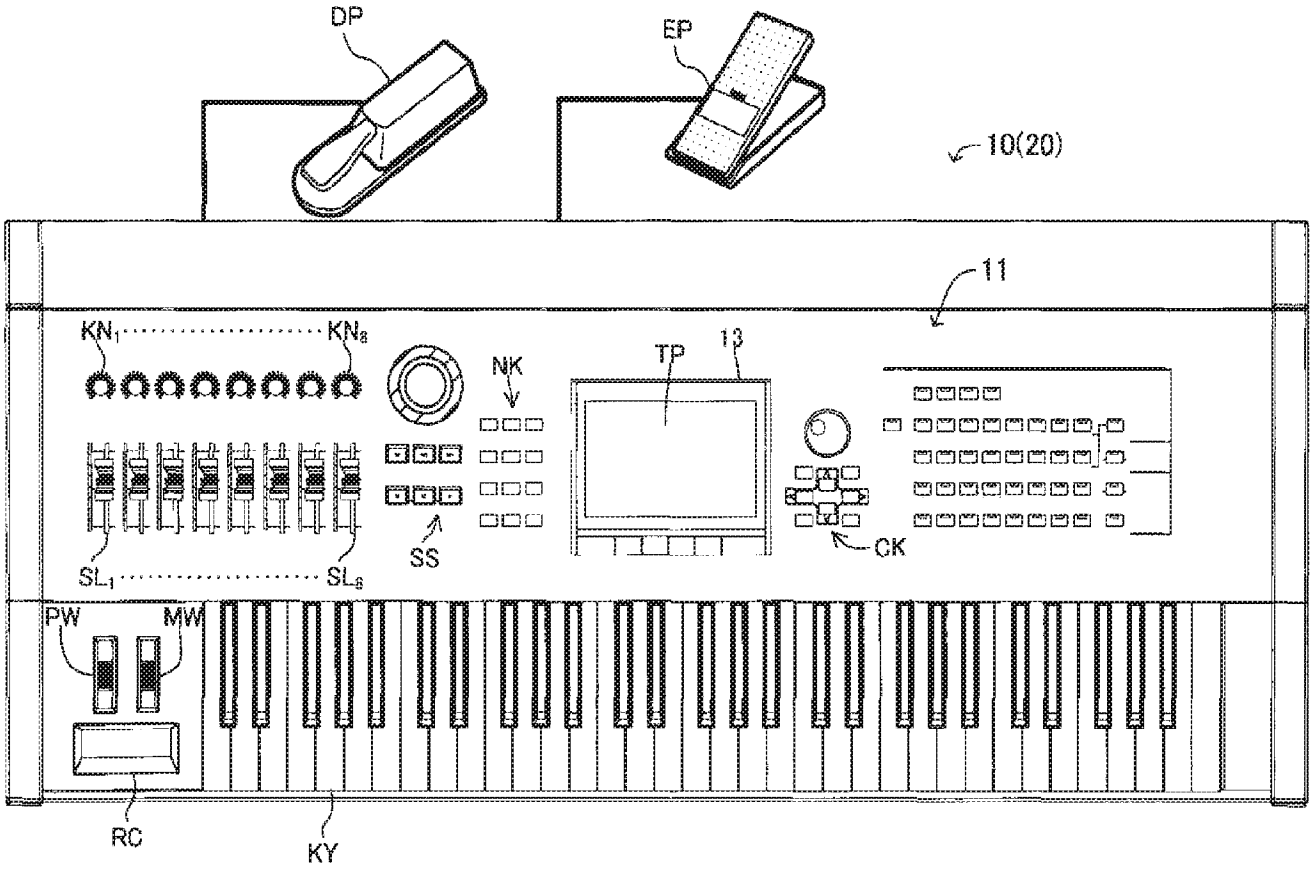
FIG. 2 is a plan view of the electronic musical instrument of FIG. 1.

As shown in FIG. 2, the electronic musical instrument 10 includes a plurality of input manipulators 11. That is, the input manipulators 11 include a keyboard KY for indicating a start and a stop of generation of a musical sound. Also, the input manipulators 11 include one or more pieces of hardware for indicating that a behavior of a musical sound is changed, for example, a pitch bend wheel PW, a modulation wheel MW a ribbon controller RC, rotary assignable knobs $KN_1$ to $KN_8$, sliding levers $SL_1$ to $SL_8$, a damper pedal DP, and an expression pedal EP. Also, the input manipulators 11 include, for example, a touch panel TP and cursor keys CK for selecting various setting items, and numeric keys NK for inputting values of various parameters. Also, the input manipulators 11 include a start/stop switch SS for controlling the reproduction and the stop of the musical sound control pattern data. The input manipulators 11 include, for example, a switch corresponding to an on/off manipulation, a rotary encoder or a rotary potentiometer corresponding to a rotational manipulation, a linear encoder or a linear potentiometer corresponding to a slide manipulation, and various sensors. When a user manipulates the input manipulator 11, information representing the manipulation contents of the manipulator 11 is supplied to the computer part 12 described below through the bus 19. In addition, instead of a part or all of the manipulators constructed of hardware, it may be configured to display an image imitating the manipulator on the display 13 and supply information representing the manipulation contents of the manipulator to the computer part 12 according to a manipulation of the touch panel TP.

The computer part 12 includes a CPU 12*a*, a ROM 12*b*, a RAM 12*c* and a timer 12*d* which are connected to the bus 19. The CPU 12*a* reads various programs from the ROM 12*b*, and executes various pieces of processing. For example, the CPU 12*a* controls the sound generation circuit 16 described below, and generates a digital musical sound signal. Also, for example, the CPU 12*a* controls the effect circuit 17, and gives an effect on a musical sound represented by the digital musical sound signal.

Also, the CPU 12*a* generates display data representing the contents of display using graphic data, character data, etc., and supplies the data to the display 13.

Figures 3, 4:
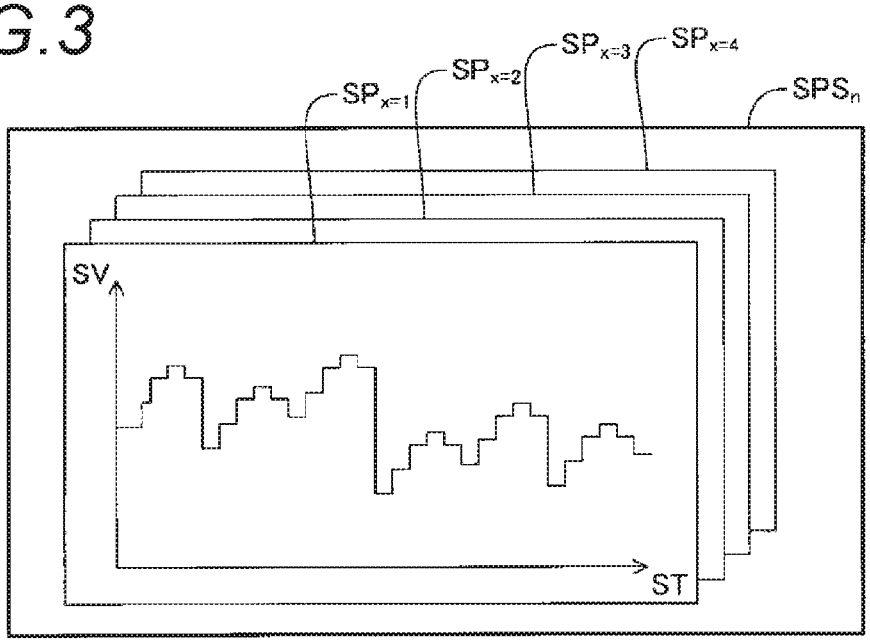
FIG. 3 is a conceptual diagram of a musical sound control pattern data set according to a first embodiment of the present invention.
FIG. 4 is a table showing a correspondence relation between reproduced musical sound control pattern data and the key velocity range.

In addition to the various programs, graphic data, character data, etc. for generating display data representing an image displayed on the display 13, and an initial value of each parameter are stored in the ROM 12*b*. For example, a plurality of musical sound control pattern data sets $SPS_{n=1, 2, \ldots}$ are stored in the ROM 12*b*. The musical sound control pattern data set $SPS_n$ includes a plurality of (for example, four) musical sound control pattern data $SP_{x=1\text{-}4}$ each representing time variation patterns of parameters defining behaviors of musical sounds as shown in FIG. 3. As described below in detail, the electronic musical instrument 10 includes an operation mode of selecting a control pattern of the behavior of the musical sound according to a pressure at which a key of the keyboard KY is pressed. Each of the musical sound control pattern data $SP_x$ corresponds to the range of the key velocity. Concretely, as shown in FIG. 4, the musical sound control pattern data $SP_{x=1}$ is selected when the key velocity is in the range from "1" (inclusive) to "32" (exclusive). The musical sound control pattern data $SP_{x=2}$ is selected when the key velocity is in the range from "32" (inclusive) to "64" (exclusive). The musical sound control pattern data. $SP_{x=3}$ is selected when the key velocity is in the range from "64" (inclusive) to "96" (exclusive). The musical sound control pattern data $SP_{x=4}$ is selected when the key velocity is in the range from "96" (inclusive) to "128" (exclusive). In this embodiment, the minimum value of the key velocity is "1", and the maximum value of the key velocity is "127".

Figure 5:
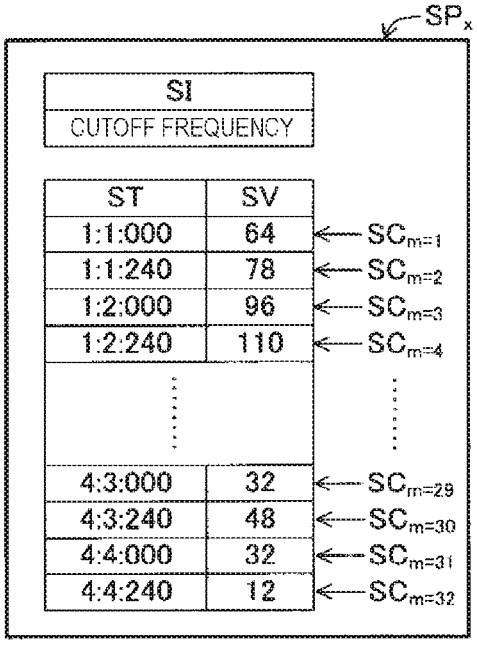
FIG. 5 is a table showing a configuration of the musical sound control pattern data.

The musical sound control pattern data $SP_x$ includes parameter identification data SI representing a parameter kind, and a plurality of musical sound control data $SC_{m=1, 2, \ldots}$ as shown in FIG. 5. The parameter identification data SI is data (for example, a name of the parameter) identifying the parameter capable of being controlled by the sound generation circuit 16 or the effect circuit 17. In an example of FIG. 5, the parameter identification data SI represents a cut-off frequency of a filter circuit of the sound generation circuit 16. Each of the musical sound control data $SC_m$ includes timing data ST representing a time at which the value of the parameter is changed, and a set value SV of the parameter. The timing data ST in FIG. 5 represents bar: beat: the number of clocks. Also, the number of clocks of one beat is set at "480". The length of the musical sound control pattern data $SP_x$ shown in FIG. 5 is four bars. In this embodiment, the parameter identification data SI of the musical sound control pattern data $SP_{x=1\text{-}4}$ are common.

At the time of executing various programs, various data are temporarily stored in the RAM 12*c*. The timer 12*d* includes a clock generator for outputting a clock signal (pulse). This clock signal is used as, for example, a reference signal in the case of reproducing a pattern of over-time change of a value of a parameter at a set tempo.

The display 13 includes, for example, a liquid crystal display (LCD). The display 13 displays an image based on display data supplied from the CPU 12*a*. For example, a name of a musical sound selected at present, and values of various parameters defining a behavior of the musical sound are displayed. As described above, the display 13 may include the touch panel TP.

Also, the storage device 14 includes a high-capacity nonvolatile storage medium such as an HDD or a DVD, and a drive unit corresponding to the storage medium. Also, the storage device 14 may include a mass flash memory. The above-described musical sound control pattern data $SP_x$, values of other parameters, etc. may be stored in the storage device 14.

The external interface circuit 15 includes, for example, a connecting terminal capable of connecting the electronic musical instrument 10 to an external device such as another electronic musical instrument or a personal computer with wires, or a circuit capable of connecting the electronic musical instrument 10 to the external device in wireless. The electronic musical instrument 10 can also be connected to a communication network such as a LAN (Local Area Network) or the Internet through the external interface circuit 15.

A waveform memory WM is connected to the sound generation circuit 16. A plurality of musical sound waveform data respectively representing acoustic waveforms of a piano, an organ, a violin, a trumpet, etc. are stored in the waveform memory WM. The sound generation circuit 16 reads the musical sound waveform data specified by the CPU 12*a*, from the waveform memory WM. Then, each of the musical sound waveform data is modified according to a value of a parameter supplied from the CPU 12*a* to generate a digital musical sound signal, and the digital musical sound signal is supplied to the effect circuit 17. In addition, the method of the sound generation circuit 16 is not limited to a waveform memory method, and any other method such as an FM (frequency modulation) method, a physical model method or an analog simulation method can be adopted. Also, the digital musical sound signal is not limited to a signal constructed by dedicated hardware, and may be generated by software processing by the CPU, DSP, etc. Also, a digital sound signal such as a voice or an effect sound may be generated without being limited to the musical sound. The sound generation circuit 16 is one example of the sound signal generator.

The effect circuit 17 gives a sound effect such as a reverberation or a chorus to the musical sound represented by the digital musical sound signal according to the value of the parameter supplied from the CPU 12*a*, and supplies to the sound system 18. The effect circuit 17 is one example of the sound signal generator and may be formed of a hardware circuit configuration or the signal of the effect circuit 17 may be generated by software processing by the CPU, DSP, etc.

The sound system 18 includes a D/A converter for converting the digital musical sound signal supplied from the effect circuit 17 into an analog musical sound signal, and an output terminal for outputting the analog musical sound signal. Alternatively, it is always unnecessary for the electronic musical instrument 10 to include the sound system 18. In this case, the electronic musical instrument 10 can output the digital musical sound signal to an external device, and the digital musical sound signal can be converted into the analog musical sound signal by a sound system in the external device.

Figure 6:
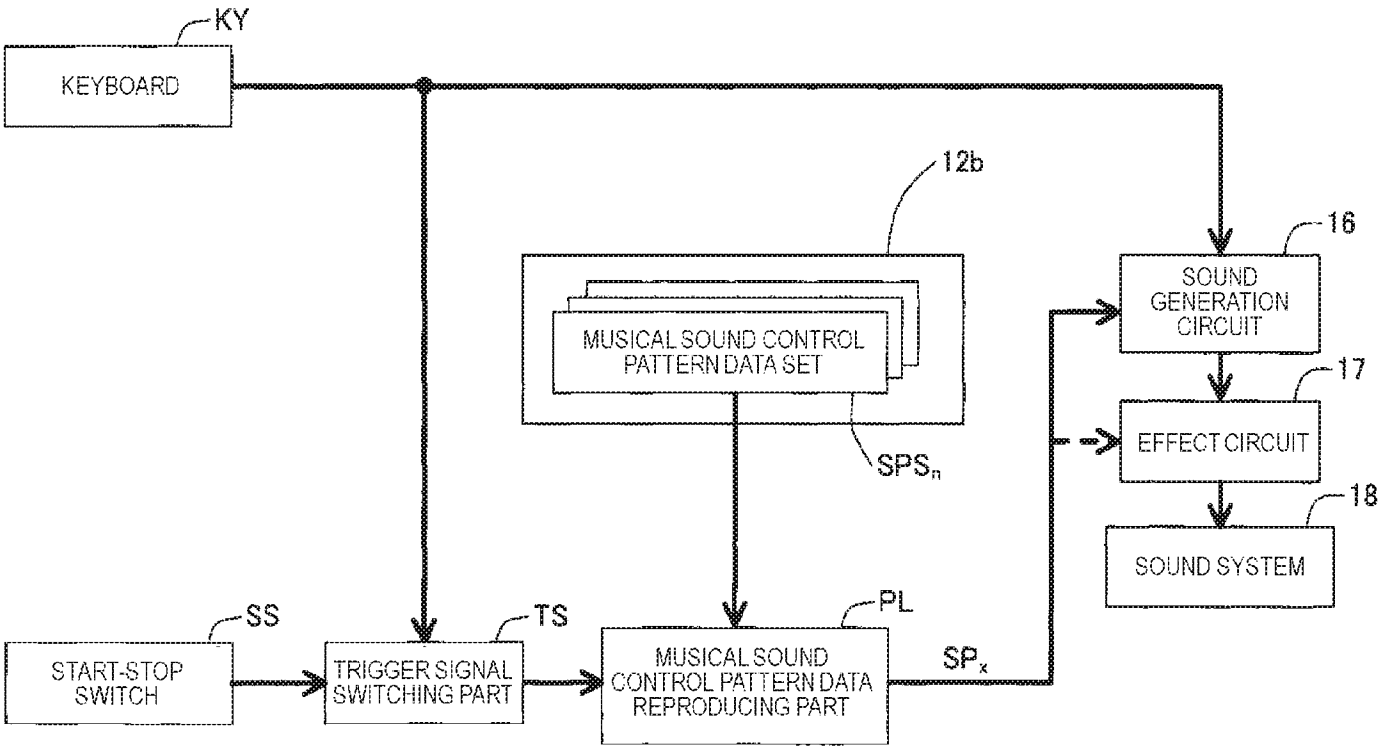

Next, operation of the electronic musical instrument 10 will be described. Particularly, a musical sound control function will be described. When a user manipulates the cursor keys CK, the touch panel TP, etc. and starts the musical sound control function, the CPU 12*a* executes a musical sound control program (not shown). Accordingly the CPU 12*a* functions as a device including a trigger signal switching part TS and a musical sound control pattern data reproducing part PL as shown in FIG. 6. Then, using the cursor keys CK, the touch panel TP, etc., the user selects a tone and the musical sound control pattern data set $SPS_n$, and also sets a reproduction tempo of the musical sound control pattern data set $SPS_n$. The tone, the musical sound control pattern data set $SPS_n$, and the tempo can be changed even during playing. Then, the user manipulates the cursor keys CK, the touch panel TP, etc., so that the operation mode (a first operation mode or a second operation mode) for reproduction and stop of the musical sound control pattern data $SP_x$ is selected.

In both of the operation modes, when a key of the keyboard KY is pressed, the keyboard KY supplies key-on information representing the velocity and the pitch of the pressed key to the sound generation circuit 16. Also, when the pressed key is released, the keyboard KY supplies key-off information representing the pitch of the released key to the sound generation circuit 16. Also, the external interface circuit 15 supplies key-on information and key-off information supplied from an external device to the sound generation circuit 16. The sound generation circuit 16 starts generation of a digital musical sound signal according to the key-on information. Also, the sound generation circuit 16 stops generation of a digital musical sound signal according to the key-off information. The key-on information and the key-off information may correspond to sound-generation information in the present invention.

The trigger signal switching part TS switches a trigger signal supplied to the musical sound control pattern data reproducing part PL according to the operation mode as described below. The trigger signal switching part TS is supplied with an output signal of the start/stop switch SS, an output signal of the keyboard KY the key-on information and the key-off information supplied from the external device. In the first operation mode, the trigger signal switching part TS supplies the output signal of the start/stop switch SS to the musical sound control pattern data reproducing part PL as the trigger signal. On the other hand, in the second operation mode, the trigger signal switching part TS supplies the output signal of the keyboard KY the key-on information and the key-off information supplied from the external device to the musical sound control pattern data reproducing part PL as the trigger signal.

In the first operation mode, the musical sound control pattern data reproducing part PL repeatedly reproduces selected data (for example, the musical sound control pattern data $SP_{x=1}$) of the musical sound control pattern data $SP_x$ of the selected musical sound control pattern data set $SPS_n$. That is, when the start/stop switch SS is switched from an off state to an on state in the first operation mode, the musical sound control pattern data reproducing part PL reads the musical sound control pattern data $SP_{x=1}$ from the ROM 12*b*, the storage device 14, etc. Then, the musical sound control pattern data reproducing part PL, calculates timing at which the value of the parameter is changed based on the set tempo and the timing data ST. Then, at each of the calculated timings, the set value SV of the parameter and the parameter identification data SI corresponding to the timing are supplied to the sound generation circuit 16. When the musical sound control pattern data $SP_x$ is supplied while the sound generation circuit 16 generates a musical sound signal, the behavior of a musical sound represented by the musical sound signal is changed according to the musical sound control pattern data $SP_x$.

When the start/stop switch SS is switched from the on state to the off state in the first operation mode, the musical sound control pattern data reproducing part PL stops reproduction of the musical sound control pattern data $SP_{x=1}$.

When key-on information is supplied as the trigger signal in the second operation mode, the musical sound control pattern data reproducing part PL reproduces one musical sound control pattern data $SP_x$ of the musical sound control pattern data $SP_{x=1}$ to $SP_{x=4}$ of the musical sound control pattern data set $SPS_n$ according to the key velocity included in the key-on information. That is, the musical sound control pattern data reproducing part PL reproduces the musical sound control pattern data $SP_{x=1}$ when the key velocity is in the range from "1" (inclusive) to "32" (exclusive). The musical sound control pattern data reproducing part PL reproduces the musical sound control pattern data $SP_{x=2}$ when the key velocity is in the range from "32" (inclusive) to "64" (exclusive). The musical sound control pattern data reproducing part PL reproduces the musical sound control pattern data $SP_{x=3}$ when the key velocity is in the range from "64" (inclusive) to "96" (exclusive). The musical sound control pattern data reproducing part PL reproduces the musical sound control pattern data $SP_{x=4}$ when the key velocity is in the range from "96" (inclusive) to "128" (exclusive). The range of the key velocity may be fixed or may be changed by a user. Also, the range size of the key velocity may differ per musical sound control pattern data $SP_x$. Also, the musical sound control pattern data $SP_x$ reproduced in any range of the key velocity may be included.

Also, the musical sound control pattern data reproducing part PL has a plurality of (e.g., three in this embodiment) retrigger modes in the second operation mode. A user manipulates the cursor keys CK, the touch panel TP, etc., to select one mode of a first retrigger mode, a second retrigger mode and a third retrigger mode.

In the first retrigger mode, in the case where new key-on information is supplied during reproduction of the musical sound control pattern data, the musical sound control pattern data reproducing part PL moves the reproduction position of the musical sound control pattern data to its head, and continues the reproduction of the musical sound control pattern data. Also, in the case where all the keys are released (the case equal to the case where all the keys are in non-manipulation states), the musical sound control pattern data reproducing part PL stops the reproduction of the musical sound control pattern data.

In the second retrigger mode, in the case where new key-on information is supplied during reproduction of the musical sound control pattern data, the musical sound control pattern data reproducing part PL continues the reproduction of the musical sound control pattern data being reproduced. After the musical sound control pattern data is reproduced to the tail of the musical sound control pattern data being reproduced, the musical sound control pattern data reproducing part PL returns to the head of its musical sound control pattern data and continues its reproduction. Also, in the case where ail the keys are released (the case equal to the case where all the keys are in non-manipulation states), the musical sound control pattern data reproducing part PL stops the reproduction of the musical sound control pattern data. Then, in the case where new key-on information is supplied, the musical sound control pattern data reproducing part PL starts reproduction from the head of musical sound control pattern data corresponding to the new key-on information.

In the third retrigger mode, the musical sound control pattern data reproducing part PL starts reproduction from the head of musical sound control pattern data corresponding to first key-on information using the first key-on information as a trigger, and repeats its reproduction. That is, even in the case where all the keys are released (or a state equal to a state in which all the keys are released), the reproduction of the musical sound control pattern data is continued.

As described above, in the first operation mode, the musical sound control pattern data $SP_x$ can be reproduced during generation of a musical sound signal to change the behavior of the musical sound. Also, in the first operation mode, during the generation of the musical sound signal, reproduction of the musical sound control pattern data. $SP_x$ can be stopped to stop change in the behavior of the musical sound. Also, in the second operation mode, the reproduction of the musical sound control pattern data $SP_x$ can be started in synchronization with the key-on information. That is, by only supplying the key-on information, the generation of the musical sound signal is started and also, the behavior of the musical sound represented by its musical sound signal starts to be changed according to the musical sound control pattern data. Also, a user can select one of the first to third retrigger modes in the second operation mode. Thus, the electronic musical instrument 10 includes a plurality of ways for controlling the reproduction and the stop of the musical sound control pattern data, whereby a user can select the optimum way according to uses. Only one or two of the three kinds of retrigger modes may be included. Also, any other retrigger mode may be included.

Also, in the second operation mode, the musical sound control pattern data $SP_x$ of the musical sound control pattern data $SP_{x=1}$ to $SP_{x=4}$ is selected according to the key velocity. Thus, the playing behavior of a user is reflected in a control pattern of the behavior of the musical sound.

Consequently, the electronic musical instrument 10 can achieve playing representation better than that of the conventional electronic musical instrument.

Second Embodiment

Figure 7:
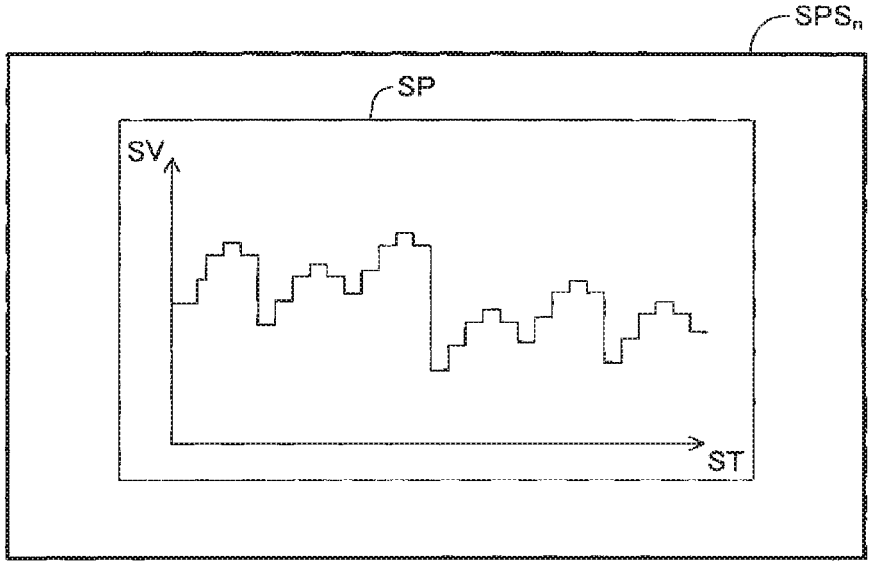
FIG. 7 is a conceptual diagram of a musical sound control pattern data set according to a second embodiment of the present invention.

Next, an electronic musical instrument 20 according to a second embodiment of the present invention will be described. A configuration of the electronic musical instrument 20 is substantially similar to that of the electronic musical instrument 10. However, as shown in FIG. 7, a musical sound control pattern data set $SPS_n$ includes one musical sound control pattern data SP.

Operation in a first operation mode of the electronic musical instrument 20 is similar to that of the first operation mode of the electronic musical instrument 10.

In a second operation mode, when key-on information is supplied, according to the key velocity included in the key-on information, a musical sound control pattern data reproducing part PL modifies the musical sound control pattern data SP of the musical sound control pattern data set $SPS_n$ and reproduces the modified musical sound control pattern data. For example, when the key velocity is in the range from "1" (inclusive) to "32" (exclusive), the musical sound control pattern data reproducing part PL reproduces musical sound control pattern data obtained by multiplying each set value SV of the musical sound control pattern data SP by a coefficient of "0.25". When the key velocity is in the range from "32" (inclusive) to "64" (exclusive), the musical sound control pattern data reproducing part PL reproduces musical sound control pattern data obtained by multiplying each set value SV of the musical sound control pattern data SP by a coefficient of "0.5". When the key velocity is in the range from "64" (inclusive) to "96" (exclusive), the musical sound control pattern data reproducing part PL reproduces the musical sound control pattern data with no change. When the key velocity is in the range from "96" (inclusive) to "127" (inclusive), the musical sound control pattern data reproducing part PL reproduces musical sound control pattern data obtained by multiplying each set value SV of the musical sound control pattern data SP by a coefficient of "1.25". In addition, operation related to a retrigger is similar to that of the first embodiment. Also, the configuration related to the range of the key velocity may be modified like any modified example of the first embodiment.

As described above, in the second operation mode of the second embodiment, the musical sound control pattern data SP is modified according to the key velocity. Thus, the playing behavior of a user is reflected in the control pattern of a behavior of a musical sound. Consequently the electronic musical instrument 20 can achieve playing representation better than that of the known electronic musical instrument.

Further, implementation of the present invention is not limited to the embodiments described above, and various changes can be made without departing from the object of the present invention.

For example, in the first embodiment, the parameter identification data SI of the musical sound control pattern data $SP_{x=1-4}$ are common, but the parameter identification data SI of the musical sound control pattern data $SP_x$ may differ from each other.

Also, in the first embodiment, the musical sound control pattern data $SP_{x=1-4}$ are assigned to their respective ranges of the key velocities, and is set so that the ranges of the key velocities do not overlap with each other. However, it is not limited to this: their respective ranges of the key velocities may overlap with each other. For example, when the key velocity is in the range from "1" (inclusive) to "64" (exclusive), it may be set so as to select the musical sound control pattern data $SP_{x=1}$ and the musical sound control pattern data $SP_{x=2}$. In this case, the parameter identification data SI of the musical sound control pattern data $SP_{x=1}$ could differ from the parameter identification data SI of the musical sound control pattern data $SP_{x=2}$. Accordingly values of two parameters can be changed simultaneously.

Also, a plurality of ranges of the key velocities may be assigned to one musical sound control pattern data $SP_x$. That is, it may be set so as to select the musical sound control pattern data $SP_{x=1}$ when the key velocity is either in the range from "1" (inclusive) to "32" (exclusive) or in the range from "96" (inclusive) to "127" (inclusive).

Also, in the first retrigger mode selected, when new key-on information is supplied during reproduction of the musical sound control pattern data, the musical sound control pattern data reproducing part PL may stop the reproduction of the musical sound control pattern data and start reproduction from the head of the musical sound control pattern data corresponding to the new key-on information.

Also, in the first embodiment, the musical sound control pattern data $SP_x$ according to the key velocity is selected. Instead of this configuration, the musical sound control pattern data $SP_x$ according to a sound range in which the pitch of key-on information is included may be selected. For example, it is assumed that the musical sound control pattern data set $SPS_n$ includes two musical sound control pattern data $SP_{x=1}$ and $SP_{x=2}$. In this example, it may be constructed so that the musical sound control pattern data $SP_{x=1}$ is selected when the pitch of the key-on information is in the range from "C3" (inclusive) to "A5" (exclusive) and the musical sound control pattern data $SP_{x=2}$ is selected when the pitch of the key-on information is either less than "C3" or "A5" or more. In addition, the range of the pitch may be fixed or may be changed by a user. Also, the musical sound control pattern data $SP_x$ may be selected according to combination of the key velocity and the pitch.

Also, in the second embodiment, the musical sound control pattern data SP is modified according to the key velocity. Instead of this configuration, the musical sound control pattern data SP may be modified according to a sound range in which the pitch of key-on information is included. For example, when the pitch of the key-on information is in the range from "C3" (inclusive) to "A5" (exclusive), the musical sound control pattern data reproducing part PL reproduces the musical sound control pattern data SP with no change. When the pitch of the key-on information is either less than "C3" or "A5" or more, the musical sound control pattern data reproducing part PL reproduces musical sound control pattern data obtained by multiplying the set value SV of the musical sound control pattern data SP by a coefficient of "1.25". In addition, in this case, the range of the pitch may be fixed or may be changed by a user. Also, the coefficient may be set according to combination of the key velocity and the pitch. Also, according to one or both of the key velocity and the pitch, the musical sound control pattern data $SP_x$ may be selected and also the musical sound control pattern data SP may be modified.

Also, for example, in the second embodiment, a reproduction tempo, a reproduction direction, etc. of the musical sound control pattern data may be changed according to the key velocity or the sound range in which the pitch of the key-on information is included.

Also, the musical sound control pattern data reproducing part PL may interpolate musical sound control data at one or a plurality of timings between the musical sound control data $SC_m$ and the musical sound control data $SC_{m+1}$. In this case, a change curve of the set value from the set value SV of the musical sound control data $SC_m$ toward the set value SV of the musical sound control data $SC_{m+1}$ can be set freely. For example, it may be set so as to linearly change the set, value from the set value SV of the musical sound control data $SC_m$ toward the set value SV of the musical sound control data $SC_{m+1}$. Also, a kind of the change curve may be selected according to the key velocity or the sound range in which the pressed key is included.

Also, the musical sound control pattern data set $SPS_n$ may be associated with a tone, and when the tone is selected, the musical sound control pattern data set $SPS_n$ associated with the tone may be selected (validated).

In addition, in the examples described in the above embodiments, the present invention is applied to the electronic musical instrument 10 having the playing manipulator, but the present invention can also be applied to a sound generation module without any playing manipulator. Also, the present invention can be applied to an electric acoustic apparatus implemented by executing a playing program in a general-purpose personal computer or a tablet computer. In those cases, playing information (sound-generation information) could be inputted from the external device through the external interface circuit 15.

Also, the example shown in FIG. 5 shows the example in which one (a total of 32) musical sound control data $SC_m$ is stored every eighth note, but this is only one example: the musical sound control data $SC_m$ may be stored at a longer timing or a shorter timing, for example, every quarter note or sixteenth note. Also, the length of the musical sound control data $SC_m$ is not limited to four bars. Also, the set value in the musical sound control pattern is not limited to be used as the parameter with no change, and may be used as the parameter after being processed.

What is claimed is:

1. An electric acoustic apparatus comprising:

a supply unit that supplies sound-generation information including timing information representing a start of a sound-generation;

a storage storing sound control pattern data representing a pattern of over-time change of a parameter defining a behavior of a sound;

a reproducer that reproduces the sound control pattern data; and a sound signal generator that generates a sound signal representing a sound according to the sound generation information and changes the behavior of the sound based on the reproduced sound control pattern data, wherein the reproducer controls a reproduction behavior of the sound control pattern data according to the sound-generation information.

2. The electric acoustic apparatus according to claim 1, wherein the reproducer modifies the sound control pattern data according to the sound-generation information.

3. The electric acoustic apparatus according to claim 1, wherein a plurality of sound control pattern data are stored in the storage, and the sound control pattern data is selected from the plurality of sound control pattern data, according to the sound-generation information by the reproducer.

4. The electric acoustic apparatus according to claim 1, wherein the sound-generation information includes information on a velocity or a pressure on a manipulator.

5. The electric acoustic apparatus according to claim 1, wherein the supply unit includes a musical instrument keyboard which supplies the sound-generation information when a key of the musical instrument keyboard is pressed.

6. The electric acoustic apparatus according to claim 5, wherein the sound-generation information includes information on a velocity or a pressure on the musical instrument keyboard.

7. The electric acoustic apparatus according to claim 6, wherein a plurality of sound control pattern data are stored in the storage, and the reproducer selects sound control pattern data from the plurality of sound control pattern data, according to the velocity or the pressure on the musical instrument keyboard included in the sound-generation information.

8. The electric acoustic apparatus according to claim 1, wherein the supply unit includes an external interface circuit to which an external equipment is connectable and receives the sound-generation information from the external equipment.

9. The electric acoustic apparatus according to claim 1, further comprising:

a manipulator that is manipulated by a user; and an operation mode switcher that changes an operation mode of the reproducer to a first operation mode in which the reproduction of the sound control pattern data is controlled according to a manipulation of the manipulator from a second operation mode in which the reproduction of the sound control pattern data is controlled according to the sound-generation information supplied from the supply unit.

10. The electric acoustic apparatus according to claim 1, wherein when the supply unit supplies new sound-generation information during reproduction of the sound control pattern data, the reproducer starts reproduction from a head of the sound control pattern data being reproduced or a head of sound control pattern data which is different from the sound control pattern data being reproduced.

11. The electric acoustic apparatus according to claim 1, wherein when the supply unit supplies new sound-generation information during reproduction of the sound control pattern data, the reproducer continues reproduction of the sound control pattern data without changing a reproduction position of the sound control pattern data.

12. The electric acoustic apparatus according to claim 1, wherein the supply unit supplies a plurality of pieces of sound-generation information simultaneously, and the reproducer stops reproduction of the sound control pattern data in a state where any of the pieces of sound-generation information is not supplied.

13. A method for reproducing sound control pattern data representing a pattern of overtime change of a parameter defining a behavior of a sound from a storage, the method comprising:

supplying, via a supply unit, sound-generation information including timing information representing a start of a sound-generation;

reproducing the sound control pattern data; and generating a sound signal representing a sound according to the sound-generation information and changing the behavior of the sound based on the reproduced sound control pattern data, wherein a reproduction behavior of the sound control pattern data is controlled according to the sound-generation information.

14. A non-transitory computer-readable storage medium storing a program that, when executed by a processor, cause the processor to reproduce sound control pattern data representing a pattern of over-time change of a parameter defining a behavior of a sound from a storage, the program, when executed by the processor, further causing the processor to execute:

reproducing the sound control pattern data; and generating a sound signal representing a sound according to sound-generation information and changing the behavior of the sound based on the reproduced sound control pattern data, wherein the sound-generation information is supplied via a supply unit and includes timing information representing a start of a sound generation, and wherein a reproduction behavior of the sound control pattern data is controlled according to the sound-generation information.

* * * * *